US007719407B2

(12) United States Patent
Pearson et al.

(10) Patent No.: US 7,719,407 B2
(45) Date of Patent: May 18, 2010

(54) VOICE ALARM SYSTEM

(75) Inventors: Charles T. Pearson, Northford, CT (US); Jonathan W. Leach, Killingworth, CT (US)

(73) Assignee: Honeywell International Inc., Morristown, NJ (US)

( * ) Notice: Subject to any disclaimer, the term of this patent is extended or adjusted under 35 U.S.C. 154(b) by 473 days.

(21) Appl. No.: 11/466,545

(22) Filed: Aug. 23, 2006

(65) Prior Publication Data

US 2008/0048839 A1 Feb. 28, 2008

(51) Int. Cl.
*G08B 17/00* (2006.01)

(52) U.S. Cl. ..... 340/286.05; 340/584; 340/539.11; 340/506; 340/692

(58) Field of Classification Search ..... 340/584, 340/628, 500, 521, 286.05, 539.11, 506, 340/692

See application file for complete search history.

(56) References Cited

U.S. PATENT DOCUMENTS 4,103,286 A * 7/1978 Nicolini et al. ..... 340/146.2
4,491,699 A * 1/1985 Walker ..... 379/174
4,894,642 A * 1/1990 Ashbaugh et al. ..... 340/692
4,914,649 A * 4/1990 Schwendeman et al. ... 340/7.43
5,283,549 A * 2/1994 Mehaffey et al. ..... 340/521
5,963,631 A * 10/1999 Fazio et al. ..... 379/202.01
6,000,505 A * 12/1999 Allen ..... 187/391
6,199,550 B1 * 3/2001 Wiesmann et al. ..... 340/523
6,904,280 B2 * 6/2005 Siegel ..... 455/431
7,142,093 B2 * 11/2006 Foster et al. ..... 340/286.05
7,218,708 B2 * 5/2007 Berezowski et al. ..... 379/37
7,221,966 B2 * 5/2007 Birli et al. ..... 455/569.1
2002/0149491 A1 * 10/2002 Crandall et al. ..... 340/691.1
2004/0196145 A1 10/2004 Foster et al.
2005/0172959 A1 * 8/2005 Williams ..... 128/201.19
2005/0212677 A1 * 9/2005 Byrne et al. ..... 340/574
2005/0227650 A1 * 10/2005 Williams ..... 455/179.1
2006/0164234 A1 7/2006 Acar
2006/0215855 A1 * 9/2006 Rauenzahn ..... 381/104

FOREIGN PATENT DOCUMENTS

EP 743623 A1 * 11/1996
GB 2198269 A * 6/1988

* cited by examiner

*Primary Examiner*—Eric M Blount
(74) *Attorney, Agent, or Firm*—Husch Blackwell Sanders Welsh & Katz

(57) ABSTRACT

A voice alarm system, coupled to a fire monitoring system responds to received wireless signals. The signals can be emitted by a portable wireless control unit that can be carried or worn by first responders.

21 Claims, 2 Drawing Sheets

VOICE ALARM SYSTEM

FIELD

The invention pertains to voice alarm systems. More particularly, the invention pertains to such systems which can be activated by a displaced, wireless control unit.

BACKGROUND

Known voice alarm systems require an emergency responder to be physically located in certain positions in an installation in order to use the alarm system. This means that information needs to be relayed from the field back to the voice alarm station and then the individual at the voice alarm station needs to decide on a course of action.

It would be desirable to be able to provide first responders with more flexible access to such systems. Preferably a first responder would be able to access a voice alarm system from almost anywhere in the respective region.

DETAILED DESCRIPTION

Figure 1:
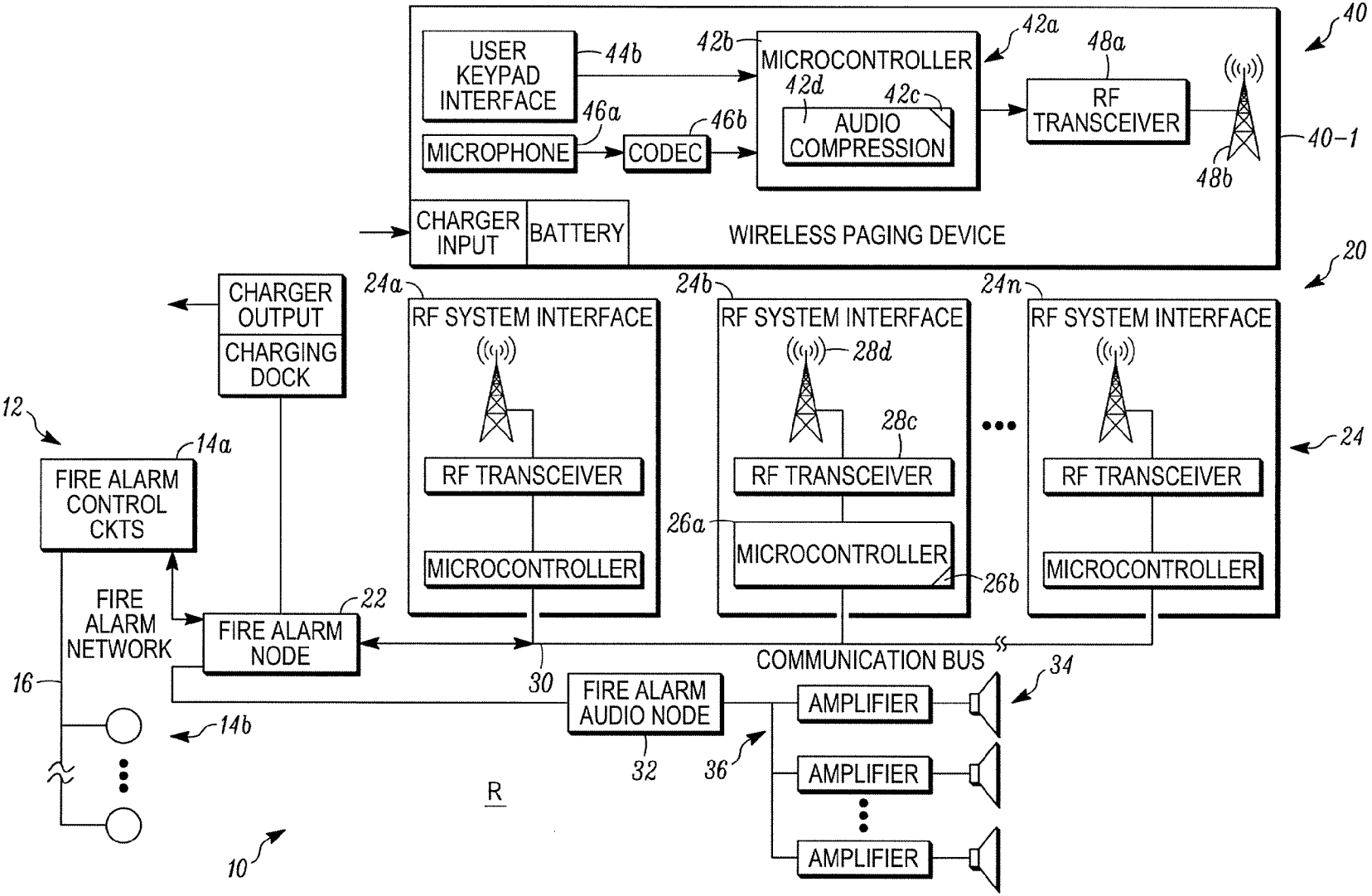
FIG. 1 is a block diagram of a system which embodies the present invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Systems which embody the present invention provide a remote wireless feed into a voice alarm station. This can result in faster, more accurate response to emergency events.

A wireless device which a first responder could carry on their person, whether it would be their own or issued at a location in a facility provides flexible access to a voice alarm system. This device communicates with receivers, for example, resonant frequency (RF) devices, located throughout the facility.

The first responder would carry the device with him when investigating an emergency. If access to the voice system was needed, a button (or combination of buttons) on the device would be pressed to activate the device and gain access to the paging function of the voice alarm system. The first responder could then page individuals to his location, initiate an evacuation, or perform any other voice command which may apply to his situation. The device could also be voice responsive.

The wireless device could be battery powered and could include an RF transceiver, a microcontroller which would communicate with the voice alarm system via the transceiver, a keypad with a user interface, a microphone input, and a CODEC to translate the microphone input into a digital signal. A charger dock for the device can maintain the battery charge and initiate a trouble signal to the fire alarm system in case of battery failure.

The RF system interface could include an RF transceiver, a microcontroller, and an interface to the voice system. The microcontroller would translate the signal received from the wireless device into a format usable by the voice system. It would also be capable of transmitting data such as system status to the wireless device.

FIG. 1 illustrates a system 10 which embodies the present invention. System 10 incorporates an ambient condition monitoring system indicated generally at 12 which might be implemented, for example, as a fire monitoring system which could include a common control element or control panel 14*a* as well as a related plurality of ambient condition detectors 14*b*. System 12 maintains conditions in a region R.

The detectors 14*b* could include, for example, smoke detectors, fire detectors, gas detectors and the like, all without limitation as would be understood by those of skill in the art. Detectors 14*b* are coupled to control circuitry 14*a* by a wired or wireless medium 16.

Associated with system 12 is a voice alarm system 20. System 20 could be a dedicated system associated with the alarm system 12 and serve no other purpose. Alternately, system 20 could include some or all of a general public address system which could be used to distribute voice or verbal information throughout the region R being monitored. The exact details in this regard are not limitations of the present invention.

System 20 includes at least one node or interface 22 which is in communication with the alarm system 12. Node 22 is also in bi-directional communication with a plurality of wireless, RF for example, interfaces 24. The members of the plurality 24, for example, 24*a*, 24*b* . . . 24*n* can be distributed throughout the region R and can but need not be substantially identical.

Interface 24*b*, for example, can include local control circuitry such as a local programmable processor and associated software 26*a*, 26*b*. The control circuitry 26*a* is in turn coupled to a radio frequency transceiver 28*c*. Transceiver 28*c* radiates RF and receives RF signals via antenna 28*d*.

Members of the plurality 24 communicate with node 22 via a wired or wireless communication bus 30. As those of skill in the art will understand, communication on the bus 30 is preferably but need not be bi-directional.

Node 22 is also coupled to an audio output node or interface circuitry 32. A plurality of verbal or audio output transducers, such as speakers 34 can be distributed throughout the region R so as to provide a way to transmit verbal messages throughout the respective region as needed. Those of skill in the art will understand that the members of the plurality 34 can in part be driven by members of a plurality 36 of audio amplifiers.

As noted previously, the members of the plurality 34 can be used to transmit messages selectively or throughout the region R either in connection with an alarm condition which has been detected by control circuits 14*a* or as part of a normal, non-alarm, verbal communication of a general matter for which public address systems would be routinely used.

Those of skill in the art will also understand that the members of the plurality 36 could be controllable on a zone-by-zone basis if desired. Alternately, each of the members of the plurality 34 could be independently controllable.

A wireless paging device indicated generally at 40 which is configured to be portable such that a first responder could carry or wear the device 40 can be used so as to enable first responders to communicate, via members of the plurality 34, with one or more areas or zones of the region R. The first responder could carry the device 40 when entering the region R to investigate an emergency condition.

Where access to the voice alarm system 20 is desirable and necessary, the first responder can use the wireless device 40 and one or more interfaces to obtain access to the functions, particularly the paging function, of the voice alarm system 20. The first responder could then page one or more individuals to his location, initiate an evacuation, or issue other voice commands which are appropriate for the situation.

Unit 40 includes control circuitry 42*a* which could be implemented as a programmable processor 42*b* which operates in conjunction with executable control software 42*c*. Audio compression software 42*d* can also be included.

Figure 2:
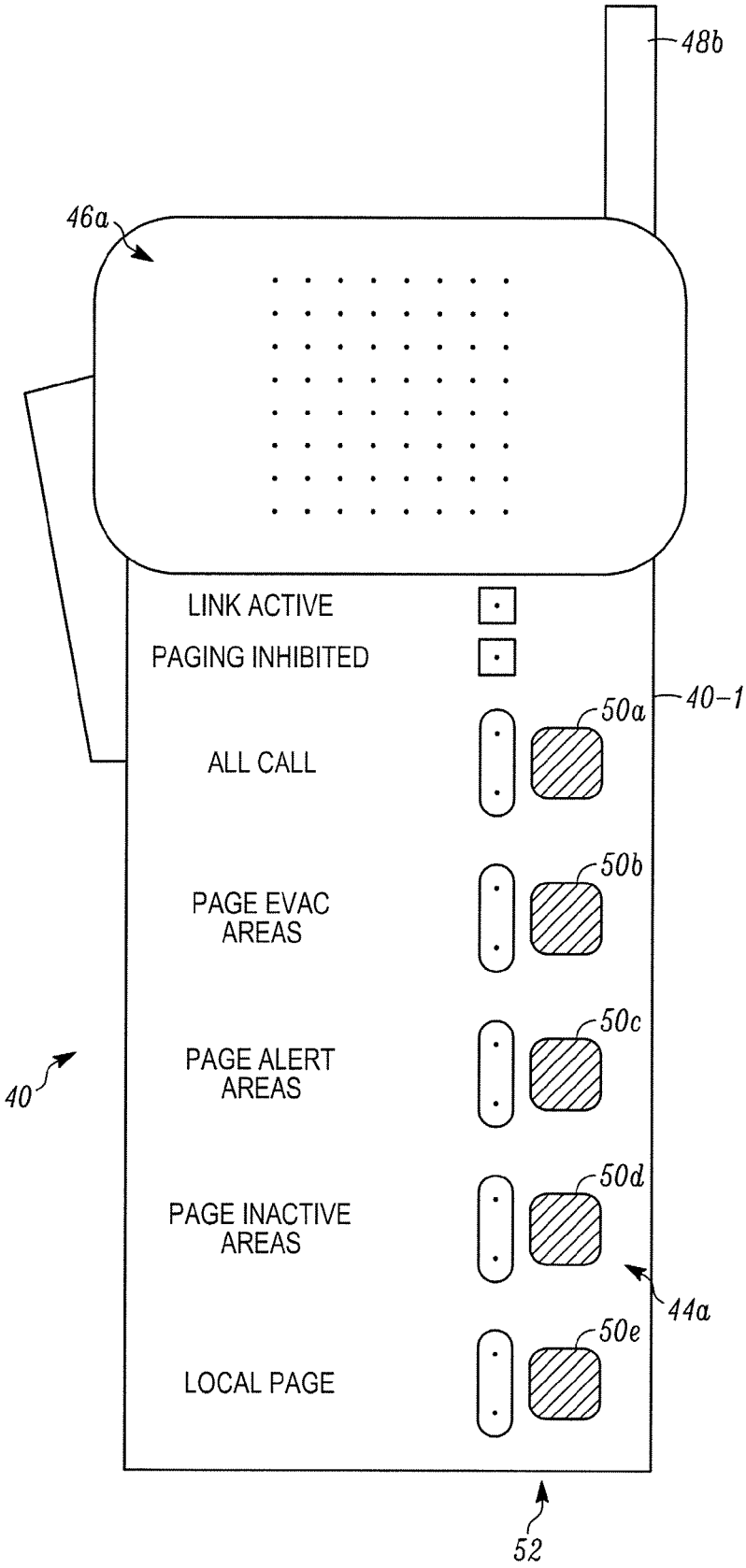
FIG. 2 is a wireless paging device which embodies aspects of the invention.

Inputs to the control circuitry 42*a* include signals from a user keypad 44*a*, best seen in FIG. 2, and associated interface 44*b*. A microphone 46*a*, and associated coding/digitizing circuitry 46*b* provide verbal input signals from a first responder or other person using the device 40 to the control circuits 42*a*.

The signals from the keypad 44*a* as well as the audio received via microphone 46*a* can be processed by control circuitry 42*a* prior to being coupled to an RF transceiver 48*a* and an associated antenna 48*b*. It will be understood that the unit 40 could be implemented with a transmitter only as opposed to the transceiver 48*a* without departing from the spirit and scope of the present invention.

Optionally, a verbal output device, such as a loudspeaker could also be incorporated into the unit 40 providing the user bi-directional audio communications. Unit 40 can be contained in a portable, wearable housing 40-1.

Using the unit 40 a first responder can output verbal messages via some or all of the members of the plurality 34. For example, as illustrated in FIG. 2, the keypad 42*a* can include a key 50*a* to activate all members of the plurality 34. It can include a key 50*b* to activate members of the plurality 34 in the areas where control circuits 40*a* have called for an evacuation. Keypad 44*a* can also include a key 50*c* to activate members of the plurality 34 in those areas of the region R where the control circuits 14*a* have issued an alert. Unit 40 can include a key 50*d* to make it possible for the first responder or other user of the device 40 to activate and communicate through those members of the plurality 34 in non-alarmed or inactive areas of the region R. Finally, a local paging function can be activated via key 50*e* to enable a first responder to communicate through those members of the plurality 34 which are relatively close to the unit 40. Status information received via the respective system interface such as 24*i* can be indicated by visual output devices, such as light emitting diodes 52.

Those of skill will understand that the keypad 44*a* illustrated in FIG. 2 is exemplary only. Other configurations and keys could be incorporated without departing from the spirit and scope of the present invention. Speech recognition software, included in control software 42*c* can provide hands free control or the user. Similarly, additional visual output devices can be provided on the unit 40.

In summary, a first responder, using a portable unit such as unit 40 can activate some or all of the members of the plurality 34 and communicate wirelessly and verbally into one or more selected areas of the region R. Such communication can be facilitated by information received from the alarm system control circuits 14*a* as to which portions of the region R have gone into alarm or, for example, have been evacuated.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A system comprising:

an ambient condition monitoring system;

a voice output system coupled to the monitoring system, the voice output system having a plurality of audio transducers and includes a wireless interface responsive to a received wireless communication at least a portion of which is to be emitted verbally by the output system; and a portable wireless device that emits wireless communications including a designation of output transducers of the voice output system to emit at least one selected verbal message, said verbal message emitted through at least some of the plurality of audio transducers based upon the designation of output transducers and a state of the ambient condition monitoring system and wherein the portable wireless device receives wireless communications from the voice output system.

2. A system as in claim 1 where the monitoring system comprises a fire monitoring system.

3. A system as in claim 2 where the voice output system includes a plurality of voice output transducers.

4. A system as in claim 3 where the wireless device includes output transducer specification circuitry.

5. A system as in claim 4 where the output transducer specification circuitry includes at least one of manually operable, or audibly activated circuitry.

6. A system as in claim 3 where the designation of output transducers includes at least, all transducers, transducers in a region being evacuated, transducers in a region having active an active alert status, transducers in a region having an inactive status, or transducers local to the wireless device.

7. A system as in claim 3 where the wireless device includes a housing, a microphone, a plurality of manually operable control members and control circuits coupled thereto.

8. A system as in claim 7 where the wireless device includes a wireless transmitter coupled to the control circuits.

9. A system as in claim 7 where the fire monitoring system responsive to a designation of output transducers to activate, couples signals to the voice output system specifying these transducers to be activated.

10. A system as in claim 9 where the transducers to be activated include at least, one of all transducers, transducers in a region being evacuated, transducers in a region having active an active alert status, transducers in a region having an inactive status, or transducers local to the wireless device.

11. A system as in claim 6 where the device includes at least one of a keypad, or, speech recognition software.

12. A wireless interface to a voice alarm system comprising:

a plurality of wireless receivers in a region that can communicate with the local voice alarm system and a plurality of portable, paging devices;

a plurality of audio transducers;

a node coupled between the plurality of wireless receivers and plurality of audio transducers, said node having an input receiving a state condition from an alarm system and selectively activating the plurality of audio transducers based upon a state condition detected on the input; and at least one portable, paging device in the region which includes a verbal output specification unit, and, an RF transceiver, wherein the paging device emits wireless communications to the receivers in the region including at least one of a designation of output transducers in the region to emit at least one selected verbal message, or, a selected verbal message to be emitted wherein the selected verbal message is emitted through at least some of the plurality of transducers based upon the designation of output transducers and the state condition provided by the alarm system and wherein the paging device receives wireless communications from at least one wireless receiver.

13. An interface as in claim 12 where the paging device includes an audio input transducer that receives voice signals to be transmitted.

14. An interface as in claim 12 where members of the plurality of receivers couple received voice to the voice alarm system.

15. An interface as in claim 12 where the output specification unit of the paging device includes a keypad.

16. An interface as in claim 15 where the keypad includes audio output specification elements and associated status indicators.

17. An interface as in claim 14 where the paging device includes a transceiver.

18. An interface as in claim 17 where the paging device presents status information to the voice alarm system.

19. An interface as in claim 18 where at least some of the members of the plurality include an RF transceiver.

20. An ambient condition monitoring system comprising:

a voice output system with an input/output port coupled to the monitoring system where the monitoring system provides a state condition to the input/output port, a plurality of verbal output transducers coupled to the port, and a wireless interface coupled to the port;

a portable wireless communications device that has at least a transceiver, a transducer selection input interface, a microphone coupled to the transceiver, and a verbal output device coupled to the transceiver, with verbal messages received by the microphone broadcast by at least some of the plurality of transducers based upon an input through the selection input interface and the state condition of the ambient condition monitoring system, and with wireless communications received by the wireless communications device broadcast by the verbal output device.

21. A system as in claim 20 wherein the input/output port receives information to be broadcast to the communications device from the monitoring system.

* * * * *